United States Patent [19]

Goans et al.

[11] Patent Number: 4,470,340

[45] Date of Patent: Sep. 11, 1984

[54] LOCKING MECHANISM FOR FLUID OPERATED ACTUATOR

[75] Inventors: Kip B. Goans, Harvey, La.; Neil H. Akkerman, Kingwood, Tex.

[73] Assignee: Baker CAC, Inc., Belle Chasse, La.

[21] Appl. No.: 353,126

[22] Filed: Mar. 1, 1982

Related U.S. Application Data

[63] Continuation of Ser. No. 136,219, Apr. 1, 1980, abandoned.

[51] Int. Cl.[3] ..... F01B 9/00

[52] U.S. Cl. ..... 92/29; 92/24; 92/85 A

[58] Field of Search ..... 92/23, 24, 26, 27, 28, 92/29, 85 A, 14

[56] References Cited

U.S. PATENT DOCUMENTS

| | | | |
|---|---|---|---|
| 2,221,121 | 11/1940 | Wallace | 92/24 |
| 3,072,105 | 1/1963 | Johnson | 92/26 |
| 3,397,620 | 8/1968 | Skelton | 92/28 |
| 4,248,138 | 2/1981 | Akkerman | 92/27 |

FOREIGN PATENT DOCUMENTS

| | | | |
|---|---|---|---|
| 164983 | 8/1953 | Australia | 92/24 |
| 2164578 | 7/1973 | Fed. Rep. of Germany | 92/26 |
| 543893 | 11/1955 | Italy | 92/26 |
| 435379 | 7/1974 | U.S.S.R. | 92/27 |

*Primary Examiner*—Abraham Hershkovitz
*Attorney, Agent, or Firm*—Norvell & Associates

[57] ABSTRACT

An automatic mechanism is provided for locking the piston rod of a multi-position fluid operated linear actuator in its existing extreme axial position and to maintain such piston rod's position against unbiased forces acting on the piston rod, in the event of a failure of, or significant decrease in, the fluid pressure applied on the piston. A lost motion connection is provided between a piston head and the piston rod opposite the locking mechanism, permitting a limited amount of axial movement of the piston head relative to the piston rod. A locking mechanism is provided to automatically engage the piston rod whenever it reaches one of its two extreme axial positions and to lock the piston rod at that position. The locking mechanism is releasable by a cam structure provided on the piston head. The initial movement of the piston head relative to the piston rod in a direction toward the other axial position of the piston rod effects the camming of the locking mechanism to an unlocked position. Means are provided to hold the locking mechanism in its unlocked position whenever the piston rod is located at its other axial position.

2 Claims, 3 Drawing Figures

LOCKING MECHANISM FOR FLUID OPERATED ACTUATOR

CROSS-REFERENCE TO RELATED APPLICATION

This application is a continuation application of co-pending application Ser. No. 136,219, filed Apr. 1, 1980, abandoned entitled Locking Mechanism for Fluid Operated Actuator.

BACKGROUND OF THE INVENTION

1. Field of the Invention

The invention relates to a novel locking mechanism for locking the piston rod, or shaft, of a fluid responsive actuator in at least one of two extreme axially spaced positions respectively corresponding to the open and closed positions of a valve member or the like manipulated by the actuator.

2. Description of the Prior Art

In oil fields, pipe lines, and refineries there has been a considerable need for a fluid actuated valve actuator which, in the event of an emergency causing the reduction or loss of control pressure supplied to the actuator, would cause the actuator to be mechanically locked in the position it held prior to the occurrence of the emergency. Depending upon the particular application, it may be desirable that the fluid operated valve actuator be mechanically locked in either its open or its closed position. More importantly, there are a significant number of valves requiring cycling operations between an open and closed position where it is desirable that such valves be locked in the same position as existed prior to the occurrence of the particular emergency. In a more common parlance, it is therefore desirable that a fluid responsive valve actuator be capable of being mechanically locked in a first position, a second position, or either a first or second position in the event of loss of, or reduction in, control pressure supplied to such valve actuator.

The invention constitutes an improvement in a locking mechanism for a fluid operated valve actuator described and claimed in U.S. patent application Ser. No. 944,050, filed Sept. 19, 1978, which is assigned to the assignee of this application.

In the aforementioned co-pending application Ser. No. 944,050, a separate fluid pressure responsive spring actuated locking mechanism independent of the main actuator piston is provided for securing the piston rod of a fluid operated actuator in either of the two extreme axially spaced positions. Such locking mechanism is a spring actuated secondary piston that locks the piston rod and main piston unit when low pressure exists, and is unlocked when higher pressure exists. Any pressure operated actuator is necessarily dependent upon the existence within the cylinder of a pressure differential across the actuator piston. It follows that a side of the piston which normally would be vented or connected to a lower pressure level could, because of the existence of unusual conditions, be exposed to a pressure sufficient to prevent fluid pressure responsive locking mechanism described in the aforesaid co-pending application Ser. No. 944,050 from locking the piston rod.

It has also been proposed in U.S. Pat. No. 2,221,121 to Wallace that a locking mechanism comprising a plurality of angular segments surrounding the piston rod be provided with camming surfaces which cooperate with similarly shaped surfaces on the piston rod, the camming surfaces being effective to move the locking segments radially outwardly on relative movement of the piston rod with respect thereto. To effect the locking of the piston rod, the annular locking segments are restrained against radially outward movement by an annular locking ring provided on a piston head which has a lost motion connection with the piston rod, and must be first moved to an unlocking position relative to the camming segments before the piston rod is enabled to cam the locking segments to their unlocked position. Both the piston head and piston rod must be moved before complete release of the locking segments is achieved, hence reacting a drag on the piston movement. In the locking sequence, the piston head and rod act in opposition on the locking segments, creating undesirable friction and the possibility that the locking segments may not lock.

SUMMARY OF THE INVENTION

The locking mechanism of this invention may be applied to any type of fluid actuator, either hydraulic or pneumatic, which incorporates a cylinder to which fluid pressure is applied, and a piston is axially shiftable within such cylinder by the applied pressure. Customarily, the piston has at least one axially extending rod or shaft portion extending outwardly through an annular seal in the end wall of the cylinder to provide a means for connecting the piston rod to a valve or other mechanism requiring actuation.

The locking mechanism embodying the instant invention employs a mechanical actuation of the locking mechanism, thus making the locking mechanism functionally independent of the existence of an appropriate pressure differential across the locking piston of the prior art. To accomplish this, a lost motion connection is provided between the piston head and the piston rod, permitting a limited axial movement of the piston head relative to the piston rod. The locking mechanism engages only the piston rod whenever such rod is moved to one of its two axially spaced positions. Such locking mechanism is moved into locking engagement with the piston rod by appropriate resilient means, but is also in engagement with a camming surface provided on the piston head. The limited axial movement of the piston head relative to the rod in a direction toward the other axial position of the piston rod effects a camming of the locking mechanism to an unlocked position. A spring biased lock retainer, which is in abutment with a shoulder on the piston rod, moves axially with the piston rod to engage the locking mechanism and hold it in its unlocked position as the piston rod moves to its other axial position.

The locking mechanism embodying this invention effects locking of the piston rod independent of the pressure conditions in the cylinder. The locking mechanism may be immediately shifted to its unlocked position through the application of pressure to the piston head to move it in a direction away from the locked position of the piston rod.

Obviously, such locking mechanism may be applied to a single acting valve actuator to hold the actuator in a first position, or in a second position. By providing two locking mechanisms within the cylinder, which are located on opposite sides of the piston, a double acting actuator may be provided with locking in both its first and second positions.

DESCRIPTION OF THE PREFERRED EMBODIMENTS

Figure 1:
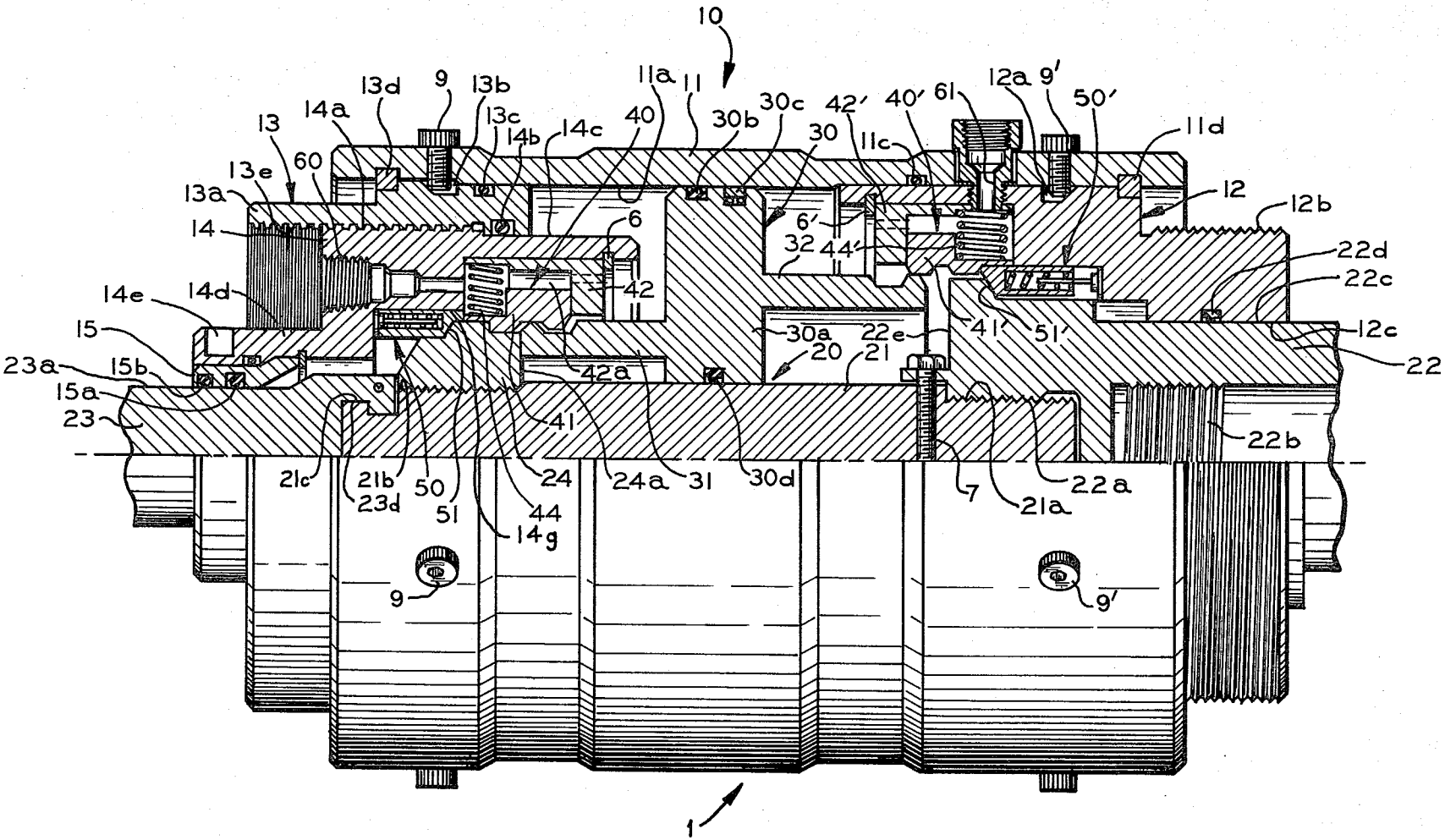
FIG. 1 is an elevational view, with the top half portion shown in vertical section, of a locking mechanism for a fluid pressure actuator embodying this invention, with the piston rod and piston head of the actuator shown in one of their two extreme axial positions.
Figure 2:
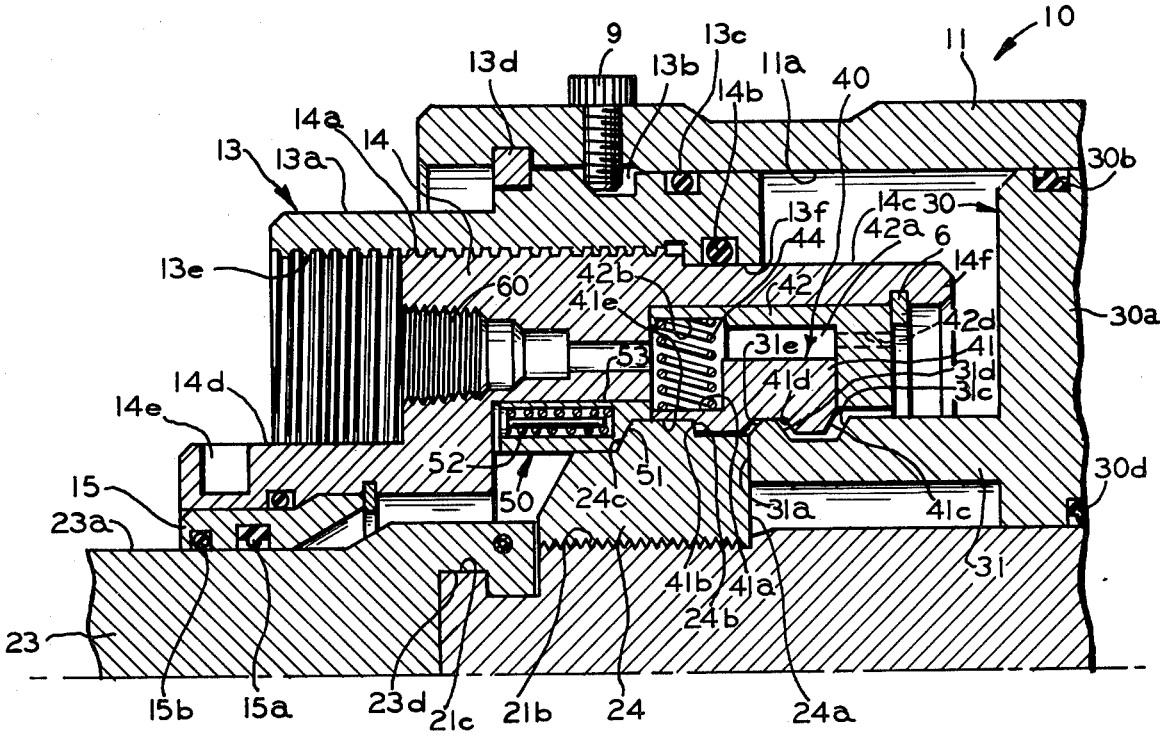
FIG. 2 is an enlarged scale view of a portion of FIG. 1.
Figure 3:
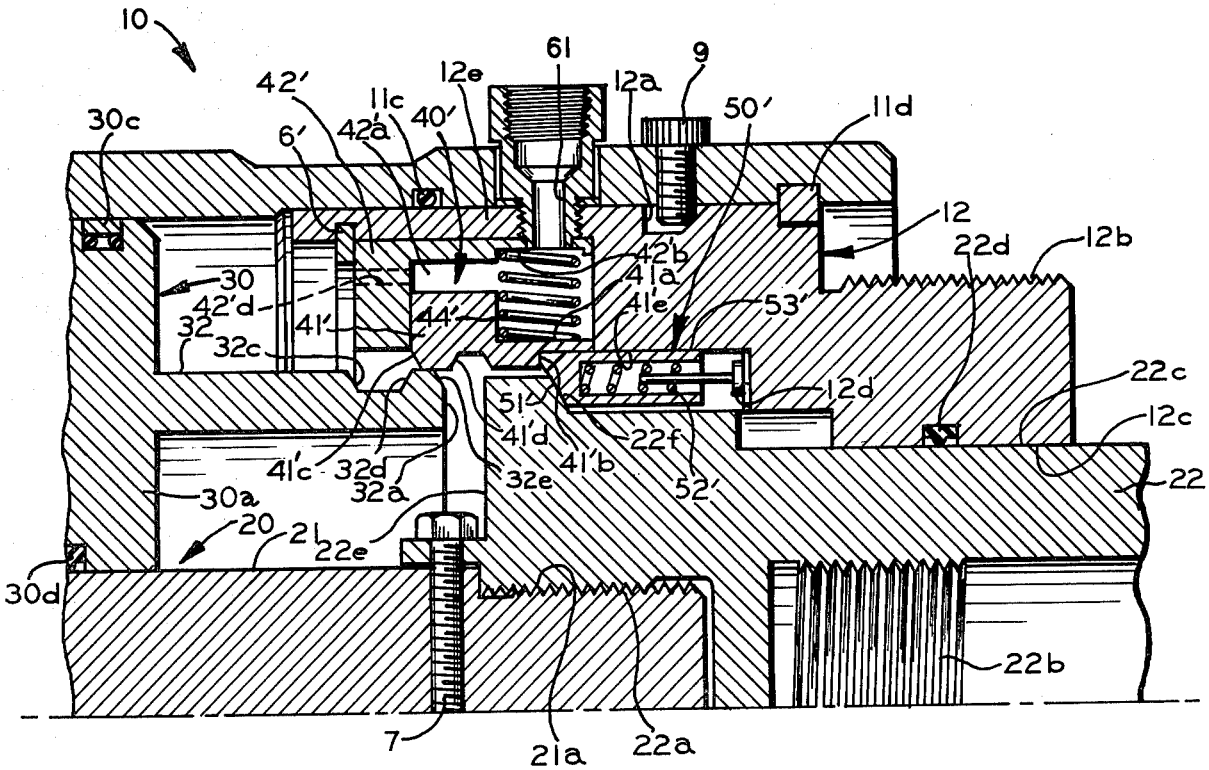
FIG. 3 is an enlarged scale view of another portion of FIG. 1.

A fluid pressure responsive actuator 1 incorporates a locking mechanism embodying this invention. Actuator 1 comprises a cylinder assembly 10, a piston rod assembly 20, and a piston head assembly 30. The locking mechanisms are indicated generally by the numerals 40 and 40' and the lock retainers by the numerals 50 and 50'.

The cylinder assembly 10 includes a generally tubular housing 11 in the opposite ends of which are respectively mounted annular end assemblies 12 and 13. End assembly 12 is secured in a fixed axial position relative to the housing 11 by a plurality of set screws 9' which engage an annular groove **12*a* formed in the periphery of end unit 12. That portion 12*b* of end unit 12 which projects axially beyond the tubular housing 11 is externally threaded to permit the mounting of the actuator to a suitable support bracket (not shown). The internal surface 12*c* of the annular end 12 cooperates in bearing relationship with the external surface 22*c* of a hollow shaft 22 which is secured at its inner end by internal threads 22*a* to an externally threaded portion 21*a* of a central piston shaft 21, and is further provided with internal threads 22*b* for engagement with an appropriate shaft or rod (not shown) to be axially reciprocated by the actuator 1. An appropriate seal 11*c* is provided between the outer cylindrical surface of the annular member 12 and the adjacent inner cylindrical surface 11*a* of the tubing 11. The annular member 12 bears against a split thrust ring 11*d* which is retained by the housing 11. A seal 22*d* is provided between the member 12 and the coupling 22**.

The other end assembly unit 13 comprises an outer annular end member **13*a* which is secured in an axially fixed position to the end of the tubing 11 by a plurality of set screws 9 engaging an annular groove 13*b* provided on the periphery of outer annular member 13*a*. An appropriate seal unit 13*c* is provided between outer annular member 13*a* and the interior wall 11*a* of tubing 11 and a split thrust ring 13*d*** is also provided.

The inner surface of outer annular end member **13*a* is internally threaded as indicated at 13*e*. Threads 13*e* cooperate with similar threads 14*a* provided on the periphery of an annular stroke adjusting member 14. A suitable seal 14*b* is provided between an axially extending cylindrical surface 14*c* of the member 14 and the internal surface 13*f* of the outer annular end member 13*a*. At its axially outer end, the stroke adjusting member 14 is provided with a reduced diameter annular extension 14*d* which in turn, appropriately mounts an annular bearing bushing 15 having seal and wiper elements 15*a* and 15*b* conventionally mounted in its internal surface for sliding and sealing engagement with the exterior surface 23*a* of a piston rod extension 23**.

It should be noted that the effective length of the piston stroke may be conveniently varied by selecting the depth of threaded engagement of the stroke adjusting member 14 relative to the outer annular end unit **13*a*. Recesses 14*e* permit a spanner wrench to engage and rotate member 14**.

The piston rod assembly 20 includes a central shaft member 21 which is provided at one end with a T-shaped protrusion **21*c* which cooperates with a correspondingly shaped slot 23*d* provided in the inner end of the piston shaft extension 23. Immediately adjacent the shaft extension 23, the central piston shaft 21 is provided with external threads 21*b* which cooperate with internal threads formed in an annular locking block 24**.

The block 24 is provided with a radial shoulder **24*b* which cooperates with the locking mechanism 40 and, additionally, with an inclined shoulder 24*c*, which cooperates with the lock retainer assembly 50, and a radial end face 24*a* which limits the movement of the piston head assembly 30**.

The other end of the central piston shaft 21 is threadably secured to hollow shaft 22 and locked in its secured position by a radially disposed bolt 7. It is apparent, therefore, that the piston rod assembly 20 is journalled for axially slidable movements within the cylinder assembly 10 through the cooperation of the piston shaft extension 23 with the bushing unit 15 and the surface **22*c* of the shaft 22 with the internal bearing surface 12*c* provided on the end assembly 12**.

The piston head assembly 30 comprises an annular mass **30*a*, having a seal 30*b* and wear bearing ring 30*c* mounted in appropriate annular grooves in its periphery. The seal 30*b* and the bearing ring 30*c* respectively cooperate with the internal cylindrical surface 11*a* of the tubing 11. The piston head 30*a* is not rigidly secured to the central piston shaft 21, but is axially slidable relative to such shaft. A seal 30*d* prevents fluid leakage between the cooperating sliding surfaces of the piston head portion 30*a* and the central piston shaft 21**.

An axially extending annular element 31 is provided on one side of the piston body **30*a* and a similar axially extending annular element 32 is provided on the opposite side. The axial movement of the piston head assembly 30 relative to the piston shaft 21 is determined by the axial spacing between the radial wall 24*a* on the piston locking block 24 and the radial end wall 22*e* on the hollow shaft 22. In the left-hand extreme position of the piston head 30 relative to the central piston shaft 21, as shown in the drawings, the radial end face 31*a* of the annular extension 31 is in abutting engagement with the surface 24*a*. In this position, a discrete spacing exists between the end face 32*a* of the oppositely directed annular piston extension 32 and the radial end face 22*e* of the hollow shaft 22. This distance represents the extent of permissible axial movement of the piston head assembly 30 relative to the central piston shaft 21. Thus, in effect, there is provided a lost motion connection between the piston head assembly 30 and the piston rod assembly 20**.

The locking mechanisms 40 and 40' are functionally identical, but may differ in diameter to fit the diameter requirements of the particular actuating sheft.

The left-hand locking unit 40 comprises a plurality of annular segments 41 which are slidably mounted for radially inward and outward shifting movement in a chamber **42*a* defined by an annular member 42 which is snugly mounted within the annular extension 14*f* of the adjustable stroke member 14** and secured therein by a split ring 6. A plurality of generally radially disposed helical springs 44 are respectively mounted between opposed surfaces 41*a* of the locking members 41 and 42*b* of the chamber defining element 42, thus biasing the segments to move radially inwardly.

In its radially inward position, the radial end face 41*b* of the annular locking element 41 is engageable in locking relationship with the radial shoulder 24*b* provided on the piston locking block 24. Additionally, the annular locking member 41 is provided with inclined camming surfaces 41*c* and 41*d* on its internal wall which respectively cooperate with similarly inclined surfaces 31*c* and 31*d* provided on the end of piston head annular extension 31. Similarly, surfaces 31*e* and 32*e* cooperate, respectively, with surfaces 41*c* and 41'*c* to assure outward displacement of the locking segments 41 and 41' during initial engagement of the extension 32.

Whenever the piston head assembly 30 is moved axially to the right, as viewed in the drawing, camming surface 31*d* on the piston head extension 31 will engage the similarly sloped camming surface 41*d* formed on the locking segments 41 and shift such segments radially outwardly, thereby releasing the surfaces 41*b* from their locking engagement with the shoulder 24*b* provided on the piston shaft locking block 24. When the piston head assembly 30 has completed its limited axial movement relative to the piston rod assembly 20, the end face 32*a* of the piston head annular extension 32 will have engaged the surface 22*e* of the piston shaft coupling member 22 and, hence, the piston head assemblage 30 and the piston rod assembly 20 thereafter move as a unit to the right to the extent permitted by the allowable stroke of the piston assemblage within the cylinder 10. Such stroke is determined by engagement of shoulder 22*f* on coupling 22 with shoulder 51' of lock retainer 50' which is then displaced axially, compressing springs 52', to bottom against shoulder 12*d* of end unit 12.

When the piston rod assembly 20 reaches its extreme right-hand position, the piston rod assembly is engaged by a locking mechanism 40' which is functionally and structurally identical to the locking unit 40 heretofore described, but, may be of a different diameter in order to accommodate any particular diameter hollow shaft 22. Thus, the locking unit 40' comprises a plurality of annular locking segments 41' which are mounted within a chamber 42'*a* defined by an annular element 42'. The chamber defining element 42' is snugly inserted within the internal surface of an internally projecting, annular flange portion 12*e* provided on the end wall unit 12, and in such position by split ring 6'. A plurality of radially disposed springs 44' are respectively mounted between a seating surface 41'*a* on each locking segment 41' and a recessed surface 42'*b* provided in the chamber defining element 42'. The annular locking engagement 41' are thus biased radially inwardly to an engaging position with the end of the shaft 22 and also the end of the annular piston head extension 32.

When the piston rod assembly 20 reaches its extreme right hand position, as previously described, a radial surface 41'*b* on each annular locking segment 41' snaps into locking position in front of the radial end surface 22*e* provided on the shaft 22.

Additionally, the internal walls of the annular segments 41' are provided with inclined cam surfaces 41'*c* and 41'*d*, which respectively cooperate with cam surfaces 32*c* and 32*d*, provided on the end of the annular piston head extension 32. It follows that subsequent axial movement of the piston head assembly 30 to the left relative to the piston rod assembly 20 will effect an outwardly camming of the radial locking segments 41' so the mechanical unlocking of the piston rod assembly 20 in the extreme right-hand position is accomplished by the left-hand motion of the piston rod assembly 30 relative to shaft assembly 20 in the same manner as previously described in connection with the locking mechanism 40 provided at the left-hand end of the actuator 1.

A lock retaining mechanism 50 is provided to cooperate with the locking mechanism 40 and a lock retaining mechanism 50' is similarly provided to cooperate with the locking mechanism 40'. The two lock retaining mechanisms 50 and 50' are functionally and structurally identical except that mechanism 50' is of a different diameter to accommodate the different diameter of the hollow shaft 22. Only one of the lock retaining mechanisms will be described in detail. Similar numbers indicate similar parts.

The lock retaining mechanism 50 comprises an annular member which is slidably mounted for axial movements within the internal cylindrical surface 14*g* of the stroke adjusting member 14. A plurality of springs 52 operate in appropriate recesses formed in the annular lock retaining element 50 and urge such element axially toward the adjacent locking assemblage 40. When the adjacent locking members 41 are displaced outwardly to their unlocked positions by the camming action of the initial movement of the piston head assembly 30 to the right relative to the piston rod assembly 20, the internal arcuate surfaces 41*e* of such locking members 41 will then be disposed radially outwardly of the external surface 53 of the lock retaining element 50. When the piston head assembly 30 completes its lost motion movement relative to the piston rod assembly 20 and the piston shaft assembly 20 begins to move to the right, as viewed in the drawing, the lock retaining element 50 is freed to move axially to a position underlying the surfaces 41*e* of the annular locking segments 41, and hence, retains such segments in their radially outward position. Upon return movement of the piston rod assembly 20 toward the left-hand side of the actuator, as viewed in the drawing, the shoulder 24*c* on the piston shaft locking block 24 engages the surface 51 of the annular lock retaining element 50 and shifts it axially to the left, thus removing it from the radial path of the locking segments 41 and permitting such segments to drop into locking engagement with the locking block 24 as the piston rod assembly 20 completes its leftward movement. The locking segments 41 present no resistance to the movement of the piston rod assembly 20 to the left since they are held or positioned outwardly by the lock retaining mechanism 50. Lock retaining assembly 50 also provides a spring cushioned stop for the left-hand movement of piston rod assembly 20.

The structure and operation of the lock retaining unit 50' relative to the annular locking segments 41' is identical to that heretofore described in connection with the lock retaining assemblage 50.

Fluid pressure may be introduced into the interior of the cylinder 10 in any conventional fashion, for example, by a conduit 60 opening in the end face of the stroke adjusting member 14. One or more conduits 42*d* are provided in the chamber defining element 42 to permit the uninterrupted passage of fluid either to or from the left side of the piston head assemblage 30. Pressurized fluid may be applied to or removed from the right-hand side of the piston head assemblage 30 by a radially disposed conduit 61 which communicates with the chamber 42'a defined by the chamber defining element 42'. One or more ports 42'd are provided in such element to permit the free passage of fluid into the cylinder chamber disposed on the right-hand side of the piston head assemblage 30.

Whenever it is desired to shift the piston rod assembly 20 to one or the other of its two extreme axial positions, it is necessary to establish a pressure differential across the opposed faces of the piston head member 30a. The initial movement of the piston head member 30a in response to such pressure differential will first effect a shifting of the particular locking members 41 or 41' that are in engagement with the piston rod assembly 20, to their unlocked positions. The piston shaft 21 will then be picked up by the piston head 30 and moved to its other extreme position, whereupon the other locking mechanisms 41 or 41', as the case may be, move into locking engagement with the piston rod assemblage 20.

It will be apparent to those skilled in the art that the described locking mechanism provides a high degree of reliability. The locking function is in no manner dependent upon or hindered by the existence or the magnitude of pressure within the cylinder unit that contains the locking mechanism. In all cases the shaft or actuating member of the assembly is immediately mechanically locked in the extreme axial position to which it is moved through the application of differential fluid pressure across the piston head assembly 30. It remains locked in such position until sufficient differential fluid pressure is applied to the piston head assembly 30 to cause such assemblage to shift in the opposite direction relative to the rod assembly 20 and effect the unlocking of the particular locking mechanism 40 or 40' that is engaged with the shaft assemblage.

It will be appreciated that the apparatus can be designed such that the piston head can travel any distance without being in contact with the locking mechanism, resulting in a comparably short piston head.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing for the spirit of the described invention.

What is claimed and desired to be secured by Letters Patent is:

1. In a fluid-operated actuator having a cylinder, a piston head reciprocable therein, an actuating piston rod extending through an end wall of the cylinder, means for supplying pressurized fluid to said cylinder to shift said piston head and rod between two selected axial positions, and a lost-motion connection between said piston head and said piston rod permitting limited axial movement of said piston head relative to said rod, the improvement comprising: a locking mechanism comprising a plurality of peripherally spaced, radially shiftable locking segments mounted for radial movement in said cylinder, resilient means for urging said locking segments into locking engagement with said piston rod only when said piston rod is in one of said selected axial positions; means directly connected to said piston head and engagable with said locking segments to shift said locking segments radially outwardly out of locking engagement with said piston rod by initial movement of said piston head toward said other axial position; an annular lock retaining sleeve mounted in said cylinder for axial movement relative to said locking segments; resilient means urging said lock retaining sleeve axially to a position radially inwardly of said locking segments to retain said locking segments in an unlocked position; said lock retaining sleeve being engaged by the final movement of said piston rod toward its said locking position to concurrently move said lock retaining sleeve out of the radial path of movement of said locking segments.

2. The locking mechanism of claim 1 wherein said resilient means urging said lock retaining sleeve axially comprises a circular array of compression springs sufficient to provide a spring cushion stop for axial movement of the piston rod toward its said locking position.

* * * * *